US006437499B1

(12) United States Patent
Seino et al.

(10) Patent No.: US 6,437,499 B1
(45) Date of Patent: Aug. 20, 2002

(54) CATHODE-RAY TUBE

(75) Inventors: Kazuyuki Seino; Takashi Nishimura; Tokuo Hashimoto, all of Fukaya; Tohru Takahashi, Osato-gun; Yuji Kuwabara, Fukaya, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/528,066

(22) Filed: Mar. 17, 2000

(30) Foreign Application Priority Data

Mar. 18, 1999 (JP) ..... 11-074122
Apr. 30, 1999 (JP) ..... 11-123792

(51) Int. Cl.[7] ..... H01J 31/20
(52) U.S. Cl. ..... 313/417; 313/408; 313/402
(58) Field of Search ..... 313/417, 2.1, 408, 313/496, 402

(56) References Cited

U.S. PATENT DOCUMENTS 5,634,837 A * 6/1997 Nishimura et al. ..... 445/25
5,831,372 A * 11/1998 Seino et al. ..... 313/2.1

FOREIGN PATENT DOCUMENTS

| | | |
|---|---|---|
| JP | 61-256551 | 11/1986 |
| JP | 61-256552 | 11/1986 |
| JP | 2-51831 | 2/1990 |
| JP | 7-45215 | 2/1995 |

* cited by examiner

*Primary Examiner*—Vip Patel
*Assistant Examiner*—Ken A Berck
(74) *Attorney, Agent, or Firm*—Pillsbury Winthrop LLP

(57) ABSTRACT

An electron gun for emitting an electron beam to a phosphor screen and for scanning one of two scanning regions defined in the phosphor screen is arranged in two necks of a vacuum envelope. A mask body of a shadow mask has two effective areas, in which numerous electron beam passage apertures are bored, defined in association with the scanning regions, and has a boundary portion defined between the effective areas and opposed to the boundary between the scanning regions of the phosphor screen. An adjustment member used to adjust a q value at a plurality of points on the boundary portion is fixed to the inner surface of the boundary portion. After the q value is adjusted, the adjustment member is fixed to the mask frame.

20 Claims, 7 Drawing Sheets

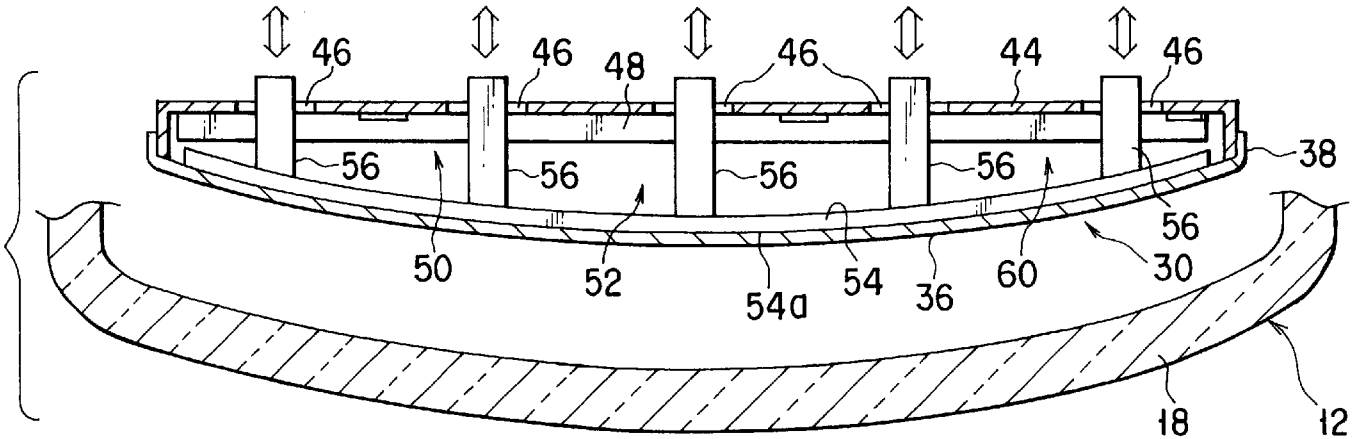
FIG. 7A
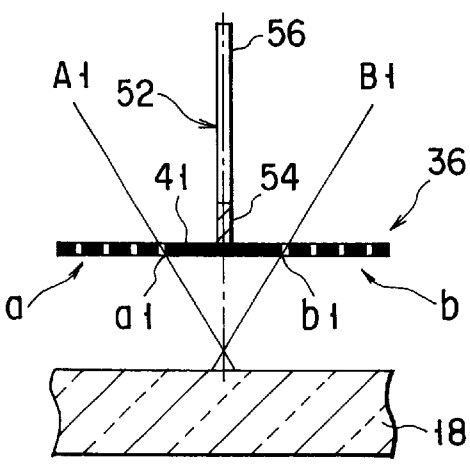
FIG. 7B
FIG. 7C
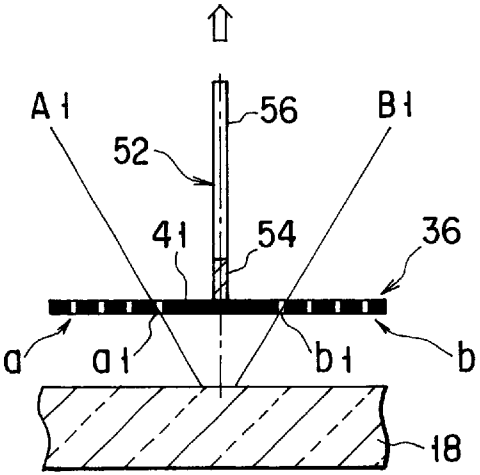
FIG. 7D

CATHODE-RAY TUBE

CROSS-REFERENCE TO RELATED APPLICATIONS

This application is based upon and claims the benefit of priority from the prior Japanese Patent Applications No. 11-074122, filed Mar. 18, 1999; and No. 11-123792, filed Apr. 30, 1999, the entire contents of which are incorporated herein by reference.

BACKGROUND OF THE INVENTION

The present invention relates to a cathode-ray tube, and more particularly, to a cathode-ray tube, in which a plurality of regions of a single phosphor screen are dividedly scanned by electron beams, and synthesizing images formed in the regions so as to produce one image.

In recent years, various discussions have been made on a high-resolution cathode-ray tube designed for high-definition broadcasting or having a large screen. For providing a cathode-ray tube with a high resolution, the diameter of a spot of an electron beam on the phosphor screen must be minimized. In contrast, the structures of electrodes constituting an electron gun have been improved or the electron gun itself has been remodeled to have a larger aperture or a larger length. However, no fruit has been born yet.

As the cathode-ray tube is made large in size, the distance from the electron gun to the phosphor screen becomes long, and the power of an electronic lens becomes too high. This is the most critical reason why no fruit has been born yet. Consequently, for realizing a high resolution, the distance from the electron gun to the phosphor screen (depth) must be decreased. At this time, if an electron beam is deflected at a wide angle, a difference in magnification between the center of the screen and the periphery thereof increases. This is therefore unacceptable in terms of the high resolution.

According to a conventionally adopted method, a plurality of electron guns and a plurality of deflection yokes are employed in order to dividedly scan a plurality of regions defined of a single phosphor screen. Images rendered in the regions are joined to produce a large image. For example, Jpn. Pat. Appln. KOKAI Publication Nos. 7-45215 and 2-51831 have disclosed cathode-ray tubes for joining two images to produce a large picture. Moreover, Japanese Unexamined Patent Publications Nos. 61-256552 and 61-256551 have proposed cathode-ray tubes for joining a larger number of images to produce a large picture.

This kind of cathode-ray tube has a vacuum envelope having a panel, a funnel including two corn portions and coupled to the panel, and two necks coupled to the funnel. A deflection unit is mounted on the external surface of each corn portion. An electron gun is arranged in each neck.

In the cathode-ray tube having the above components, electron beams emitted from the electron gun are deflected due to magnetic fields generated by the deflection units. A phosphor screen formed on the inner surface of the panel has two regions corresponding to the electron guns and the two regions are dividedly scanned by the electron beams. Sub-images rendered on the phosphor screen are joined by controlling signals to be applied to the electron guns and deflection units. Consequently, one large image having neither a break nor overlap is produced over the whole surface of the phosphor screen.

As mentioned above, the cathode-ray tube uses the electron beams emitted from the plurality of electron guns to dividedly scan a plurality of regions on the phosphor screen. For producing an image that has neither a break nor an overlap created on a boundary between adjoining scanning regions, a shadow mask must be highly precisely arranged and held at a predetermined position relative to the phosphor screen. Specifically, the phosphor screen and the electron beam passage apertures of the adjoining shadow mask must have a predetermined positional relationship.

In the cathode-ray tube having the above components, the relative positions between the shadow mask and the panel are determined in the course of manufacturing and greatly dependent on precision in assembling.

Even in a typical picture tube, if a pitch between phosphor dots in the phosphor screen or the width of a phosphor dot is different from a predetermined value by several ten $\mu$m, the difference is discernible. The precision in assembling the shadow mask and panel must be higher than several ten $\mu$m in the above-mentioned cathode-ray tube.

The precision in assembling the shadow mask and panel of a typical picture tube is about several hundred $\mu$m. In the case of the aforesaid dividedly scanning cathode-ray tube, as long as the same assembling procedure is adopted, it is hard to produce an image that is seen continuously with the boundary between adjoining sub-images indiscernible.

Moreover, the precision in a single component such as the shadow mask or panel has a significant meaning. Specifically, a difference in the precision of a produced shadow mask included in a typical picture tube, that is, a difference of any dimension of a produced shadow mask from a design value is about several hundred $\mu$m. Moreover, a difference in the precision of an inner surface of a produced panel, that is, a difference of any dimension of the inner surface from a design value is also about several hundred $\mu$m. When the difference is taken into consideration, if a dividedly scanning cathode-ray tube is produced according to a conventional configuration and a conventional assembling procedure, it is quite hard to attain desired precision in terms of the boundary between sub-images.

Moreover, a shadow mask may be thermally expanded with the impact of electron beams or may be vibrated with extraneous vibrations and howled. In this case, the relative positions of the shadow mask and phosphor screen are changed, and an electron beam is landed incorrectly. This leads to deterioration in image definition. In particular, as far as a dividedly scanning cathode-ray tube is concerned, an electron beam is likely to be landed incorrectly on the boundary portion between the scanning regions of the phosphor screen. It is hard to provide an image with continuity.

BRIEF SUMMARY OF THE INVENTION

The present invention has been contrived in consideration of the above circumstances, and its object is to provide a cathode-ray tube in which a shadow mask and an inner surface of a panel are positioned and held with a desired positional relationship established, and which can be readily produced according to a conventional manufacturing process.

For accomplishing the above object, a cathode-ray tube according to the present invention comprises a vacuum envelope including a panel that has a phosphor screen formed on an inner surface thereof; a plurality of electron guns disposed in the vacuum envelope, for emitting electron beams to the phosphor screen and dividedly scanning a plurality of scanning regions on the phosphor screen; a shadow mask arranged between the phosphor screen and the electron guns and the having a plurality of effective areas which include numerous electron beam passage apertures and are defined in association with the scanning regions, and a boundary portion defined between the effective areas and opposing to the boundary between the scanning regions of the phosphor screen; and a coupling member coupled to the boundary portion of the shadow mask in order to hold the boundary portion at a predetermined position.

With the cathode-ray tube having the above construction, the boundary portion of the shadow mask is held at the predetermined position by means of the coupling member. When the shadow mask is thermally expanded or subjected to extraneous vibrations, the coupling member works to restrain displacement of the shadow mask. The shadow mask and phosphor screen can be held at predetermined relative positions, thereby suppressing incorrect landing of electron beams on the boundary portion of the shadow mask which is attributable to a change in the gap (q value) between the inner surface of the panel and the shadow mask. Sub-images rendered on the plurality of scanning regions can be joined continuously without a break or overlap. This leads to improved image definition.

Moreover, a cathode-ray tube according to the present invention comprises a vacuum envelope including a panel that has a phosphor screen formed on an inner surface thereof; a plurality of electron guns disposed in the vacuum envelope, for emitting electron beams to the phosphor screen and dividedly scanning a plurality of scanning regions on the phosphor screen; a shadow mask arranged between the phosphor screen and the electron guns and the having a plurality of effective areas which include numerous electron beam passage apertures and are defined in association with the scanning regions, and a boundary portion defined between the effective areas and opposing to the boundary between the scanning regions of the phosphor screen; and a position adjustment mechanism used to adjust the gap between the inner surface of the panel and the shadow mask at a plurality of positions on the boundary portion of the shadow mask.

According to the cathode-ray tube having the foregoing construction, the position adjustment mechanism is provided for adjusting the gap (q value) between the inner surface of the panel and the shadow mask at the plurality of points on the boundary portion of the shadow mask. The q value can therefore be adjusted at a step preceding the step of assembling the components of the vacuum envelope. A difference of the q value from a predetermined value is attributable to a difference in precision in assembling the panel and shadow mask. The difference in precision in assembling the panel and shadow mask may attribute to a difference in precision in working a shadow mask and a different in precision in producing the inner surface of a panel. The difference of the q value is adjusted at the plurality of points on the boundary portion and thus corrected. The q value can therefore be set accurately to the predetermined value over the whole boundary portion.

Consequently, when the phosphor screen is exposed to light, phosphor layers can be formed continuously along the boundary between the scanning regions. When the cathode-ray tube is in operation, the plurality of scanning regions can be scanned accurately. Consequently, an image having neither a break nor overlap created on the boundary between the scanning regions can be displayed.

Furthermore, in the cathode-ray tube according to the present invention, the shadow mask includes a mask body in which electron beam passage apertures are bored and a mask frame attached to the periphery of the mask body. The position adjustment mechanism includes an adjustment member fixed to the mask body. After the adjustment member is used to adjust the q value, the adjustment member is fixed to the mask frame. Even when the shadow mask is thermally expanded or subjected to extraneous vibrations, the adjustment member is used to restrain displacement of the shadow mask. The shadow mask and phosphor screen can be held at the predetermined relative positions. Consequently, incorrect landing of an electron beam attributable to a change in the q value can be minimized, and image definition can be improved.

Another cathode-ray tube according to the present invention comprises a vacuum envelope including a panel that has a phosphor screen formed on an inner surface thereof; a shadow mask arranged in the vacuum envelope and opposing the phosphor screen; and a plurality of electron guns incorporated in the vacuum envelope, for emitting electron beams to the phosphor screen via the shadow mask, and dividedly scanning a plurality of scanning regions on the phosphor screen. The shadow mask includes a mask body having a plurality of effective areas in which numerous electron beam passage apertures are bored and a boundary portion defined between the effective areas and opposed to the boundary between the scanning regions of the phosphor screen, and a substantially rectangular mask frame holding the periphery of the mask body; and the mask frame includes a pair of long-side walls and a middle frame extending between the pair of long-side walls and opposing the boundary portion of the mask body.

According to the present invention, the shadow mask has a coupling member coupled to the boundary portion on the inner surface of the mask body in order to hold the boundary portion at a predetermined position.

Furthermore, in the color cathode-ray tube according to the present invention, the coupling member is fixed to the middle frame of the mask frame.

With the color cathode-ray tube having the foregoing construction, the mask frame has the middle frame. The shadow mask therefore exhibits improved rigidity. The mask body can be held at the predetermined position highly precisely on a stable basis. Moreover, the coupling member used to adjust the gap between the mask body and the inner surface of the panel is coupled to the mask body and fixed to the middle frame of the mask frame. The mask body can therefore be secured and held more precisely. The strength of the whole shadow mask improves. The shadow mask can be attached or detached to or from the panel as it is conventionally. Moreover, the color cathode-ray tube can be produced without the necessity of drastically modifying a conventional manufacturing process.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1 to 7D show a color cathode-ray tube according to an embodiment of the present invention; in which:

FIG. 1 is a perspective view showing the back of the color cathode-ray tube;

FIG. 2 is a front view showing a panel of the color cathode-ray tube;

FIG. 3 is a sectional view of the color cathode-ray tube taken along the line III—III shown in FIG. 1;

FIG. 4 is a sectional view of the color cathode-ray tube taken along the line IV—IV shown in FIG. 1;

FIG. 5 is an exploded perspective view showing a shadow mask included in the color cathode-ray tube;

FIG. 6 is a perspective view showing a fixing member included in the shadow mask; and FIGS. 7A to 7D are sectional views schematically showing a step of adjusting a q value using an adjustment mechanism included in the shadow mask;

DETAILED DESCRIPTION OF THE INVENTION

Figure 1:
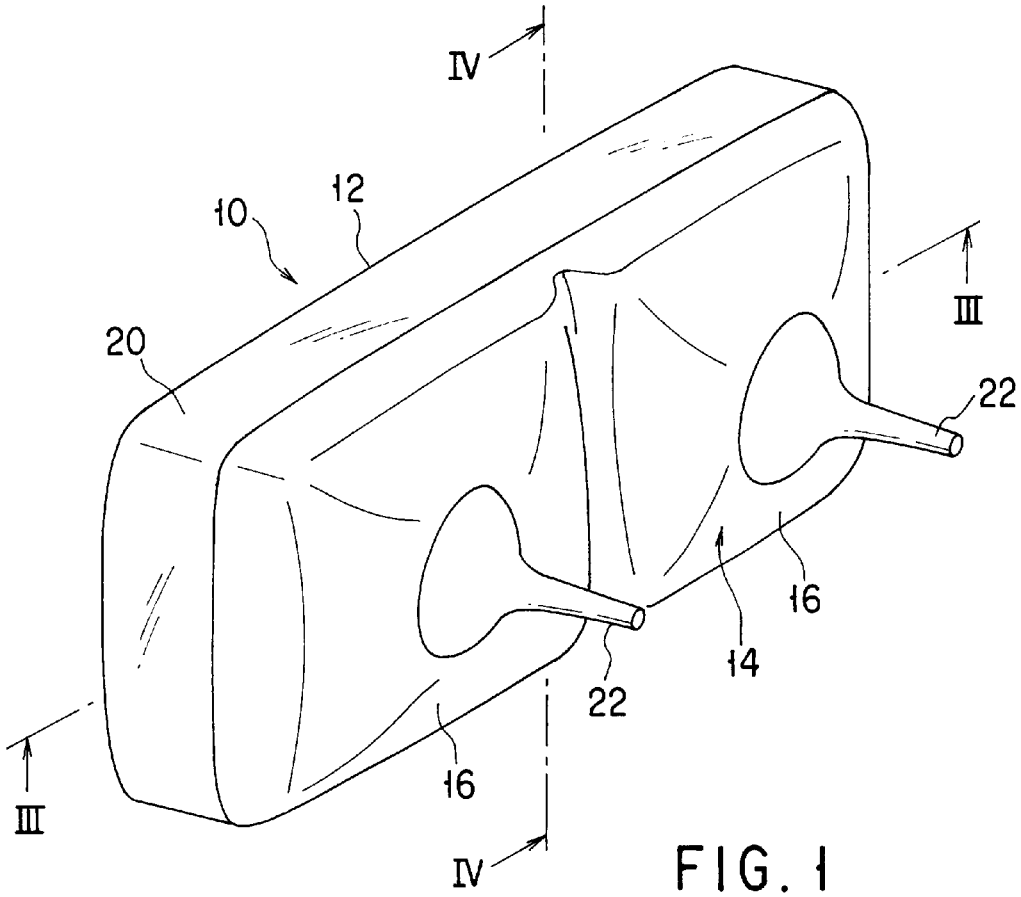

Referring to the drawings, a color cathode-ray tube according to an embodiment of the present invention will be described.

As shown in FIGS. 1 to 4, a color cathode-ray tube has a vacuum envelope 10. The vacuum envelope 10 includes a panel 12 made of a glass, and a rear housing 14 opposed to the panel, formed by unifying two funnels 16, and made of a glass. The panel 12 includes a substantially rectangular face plate 18, which has a substantially rectangular phosphor screen 15 formed on the inner surface thereof, and a skirt portion 20 erected on the periphery of the face plate. The panel 12 has a tube axis substantially perpendicular to the panel and passed through a center point of the panel. A major axis (horizontal axis) X and a minor axis (vertical axis) Y are also defined to be mutually orthogonally passing through the tube axis.

The phosphor screen 15 has three-color phosphor layers and black stripe substances. The three-color phosphor layers are formed in a strip shape extending along the minor axis Y, and are made of phosphor materials that glow in blue, green, and red. The phosphor screen 15 is a continuous united body without a seam.

The rear housing 14 is coupled to the end surfaces of the skirt portion 20 of the panel 12 using, for example, a frit glass. A neck 22 made of a glass is fixed to a small-diameter end of each funnel 16. The necks 22 extend in parallel with each other. An electron gun 24 for emitting an electron beam to the phosphor screen 15 is arranged in each neck 22. A deflection unit 28 for horizontally and vertically deflecting an electron beam emitted from each electron gun 24 is mounted on the external surface of each funnel 16.

A substantial rectangular shadow mask 30 having numerous electron beam passage apertures is incorporated in the vacuum envelope 10 and opposed to the phosphor screen 15. The shadow mask 30 is supported by the panel 12 with holder 32 engaged with studs 34. The holders 32 are fixed to a mask frame to be described later. The studs 34 project from the skirt portion 20 of the panel 12.

Figure 2:
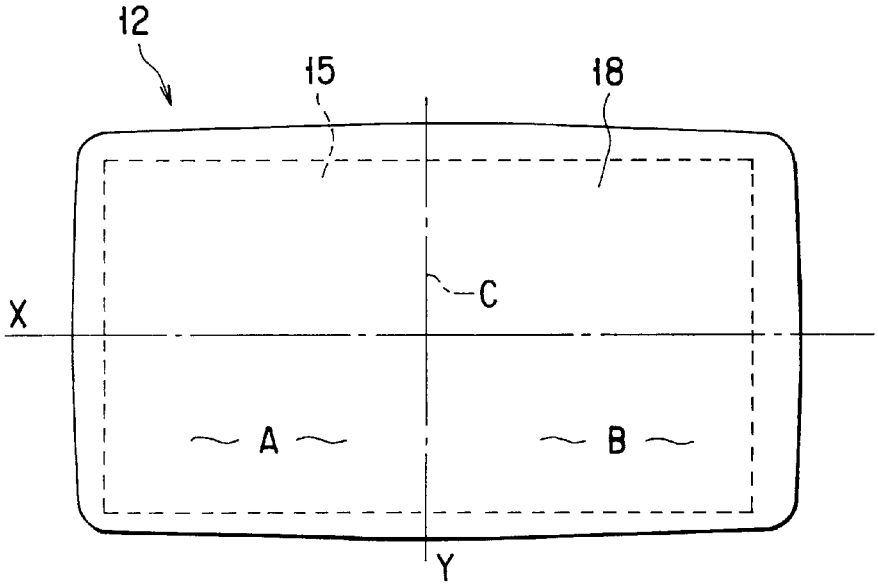
Figure 3:
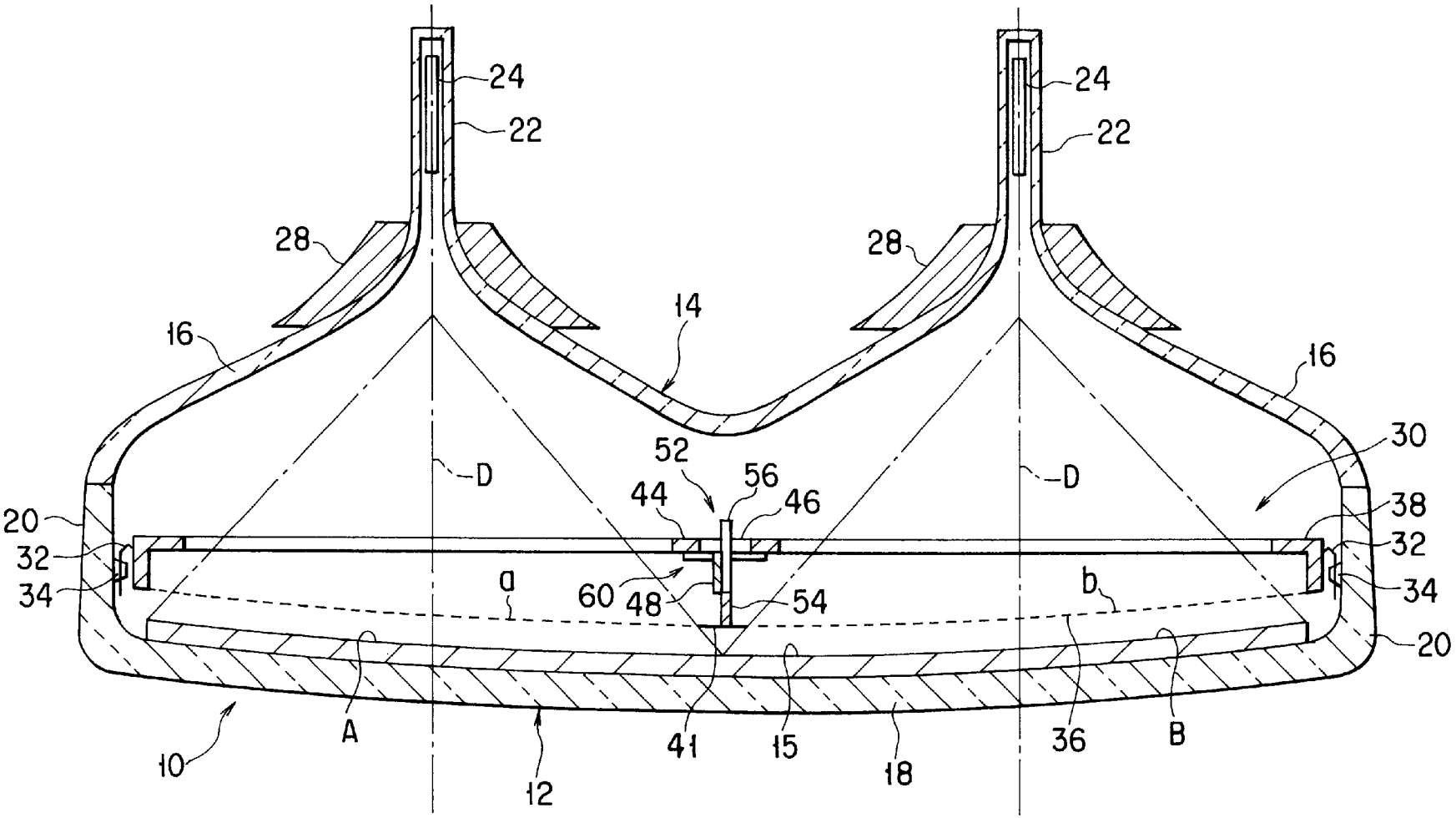

As seen from FIGS. 2 and 3, according to this embodiment, the phosphor screen 15 has two scanning regions A and B defined side by side along the major axis X with the minor axis Y as a boundary C. The scanning regions A and B have the same rectangular shape. The two necks 22 and electron guns 24 are arranged so that their center axes D will be aligned with normals passing through substantially the centers of the scanning regions A and B.

In the color cathode-ray tube having the foregoing components, electron beams emitted from the two electron guns 24 are deflected due to magnetic fields induced by the deflection units 28, and passed through the shadow mask 30. The electron beams horizontally and vertically scan the two scanning regions A and B of the phosphor screen 15. According to this dividedly scanning method, different images are rendered on the scanning regions A and B of the phosphor screen 15. The images are joined together by controlling signals to be applied to the electron guns 24 and deflection units 28. Consequently, one large image devoid of a break is reproduced over the whole surface of the phosphor screen.

Next, the structure of the shadow mask 30 will be described. As shown in FIG. 3 to FIG. 6, the shadow mask 30 comprises a substantially rectangular mask body 36 having a skirt portion extending from the periphery thereof, and a substantially rectangular mask frame 38 attached to the periphery of the mask body.

The mask body 36 has rectangular effective areas a and b defined in association with the scanning regions A and B of the phosphor screen 15, and also has a peripheral part 40 defined around the respective effective areas a and b. Numerous electron beam passage apertures 42 are bored in the effective areas a and b. A boundary portion 41 included in the peripheral part 40 is defined between the effective areas a and b. The boundary portion 41 is opposed to the boundary C between the scanning regions A and B of the phosphor screen 15. A coupling member of a position adjustment mechanism to be described later is fixed to the inner surface of the boundary portion 41, and extends from the boundary portion towards the electron guns 24 along the tube axis.

The mask frame 38 is shaped in a substantially rectangle and has side walls formed to have an L-shaped cross section. The mask frame 38 has a middle frame 44 formed as an integral part thereof on the side of the electron guns 24. The middle frame 44 is linking the side margins of the mask frame 38. In other words, the middle frame 44 serving as a bridge portion extends from the center of a long-side wall of the mask frame 38 to the center of an opposite long-side wall thereof, thus linking the long-side walls.

The middle frame 44 is placed in such a manner that the middle frame 44 will not intercept electron beams used to scan ranges necessary to render images. Specifically, the middle frame 44 is extending along the minor axis Y, opposed to the boundary portion 41 of the mask body 36, and shaped to be slightly wider than the boundary portion 41. The middle frame 44 has the center part thereof in the direction of the minor axis Y made wider than the other part, and has the width thereof made smaller towards the long-side walls of the mask frame 38. The middle frame 44 is therefore shaped substantially like a longitudinal section of a barrel as a whole. The middle frame 44 has the ability to block unnecessary electron beams of an electron beam emitted from one of the electron guns 24 associated with one scanning area. The unnecessary electrons are likely to fall on the other scanning region.

In the middle frame 44, a plurality of rectangular openings 46, for example, five rectangular openings 46 are bored in tandem along the minor axis Y. Adjustment tongues of a coupling member to be described later are passed through the openings 46, whereby the coupling member can be manipulated from outside the mask frame 38.

The middle frame 44 is provided on the bottom of the mask frame 38 on the side of the electron guns 24. The middle frame 44 can therefore be formed as an integral part of the mask frame 38 during press working. The mask frame can therefore be produced at substantially the same cost as existing mask frames.

The mask frame 38 has a fixing portion 48 for holding the coupling member to be described later. According to this embodiment, the fixing portion 48 is formed by welding a fixing member 60, which is separate from the mask frame 38, to the middle frame 44.

Figure 6:
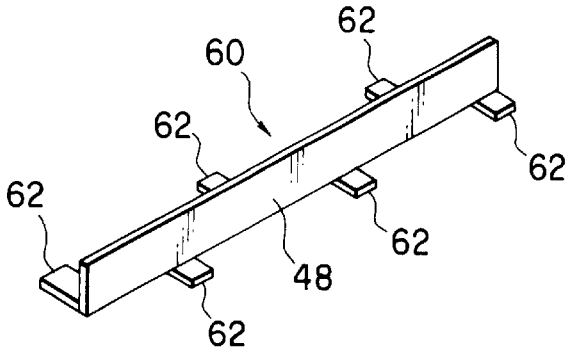

More specifically, as shown in FIG. 6, the fixing member 60 is formed by bending a metallic plate, and has an elongated rectangular fixing portion 48 and six leg portions 62 jutted out from one margin of the fixing portion vertically to the fixing portion. The leg portions 62 are arranged equidistantly in the longitudinal direction of the fixing portion 48 at intervals of a predetermined distance, and jutted alternately in opposite directions.

The fixing member 60 has the six leg portions 62 thereof welded to the middle frame 44 and is thus fixed to the middle frame. The leg portions 62 are welded to portions of the middle frame 44 other than the openings 46. With the fixing member 60 fixed to the middle frame 44, the fixing portion 48 of the fixing member 60 extends along the minor axis Y and stands erect towards the mask body 36 substantially perpendicular to the middle frame 44.

The shadow mask 30 having the aforesaid components includes a position adjustment mechanism 50 used to adjust the gap between the mask body 36 and the inner surface of the panel, that is, a q value. The position adjustment mechanism 50 has a coupling member 52 shaped like a comb and formed with a metallic plate. The coupling member 52 acts as an adjustment member according to the present invention.

Figure 4:
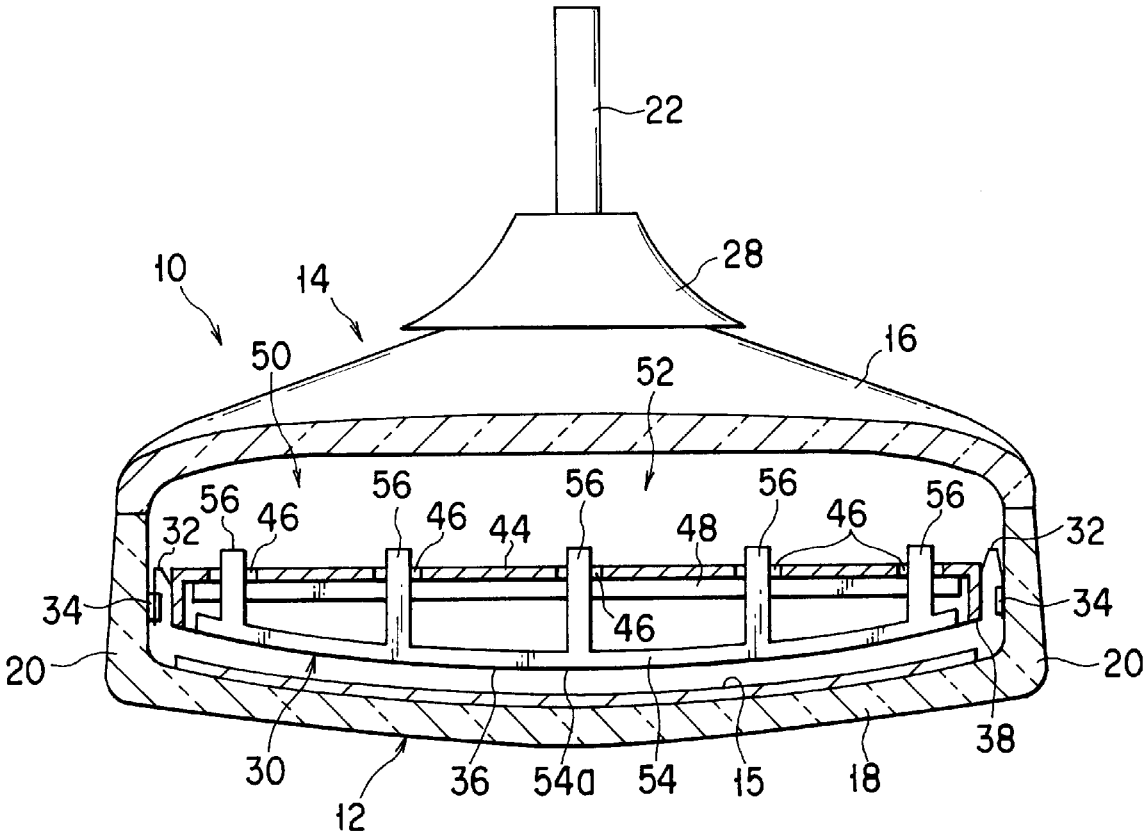
Figure 5:
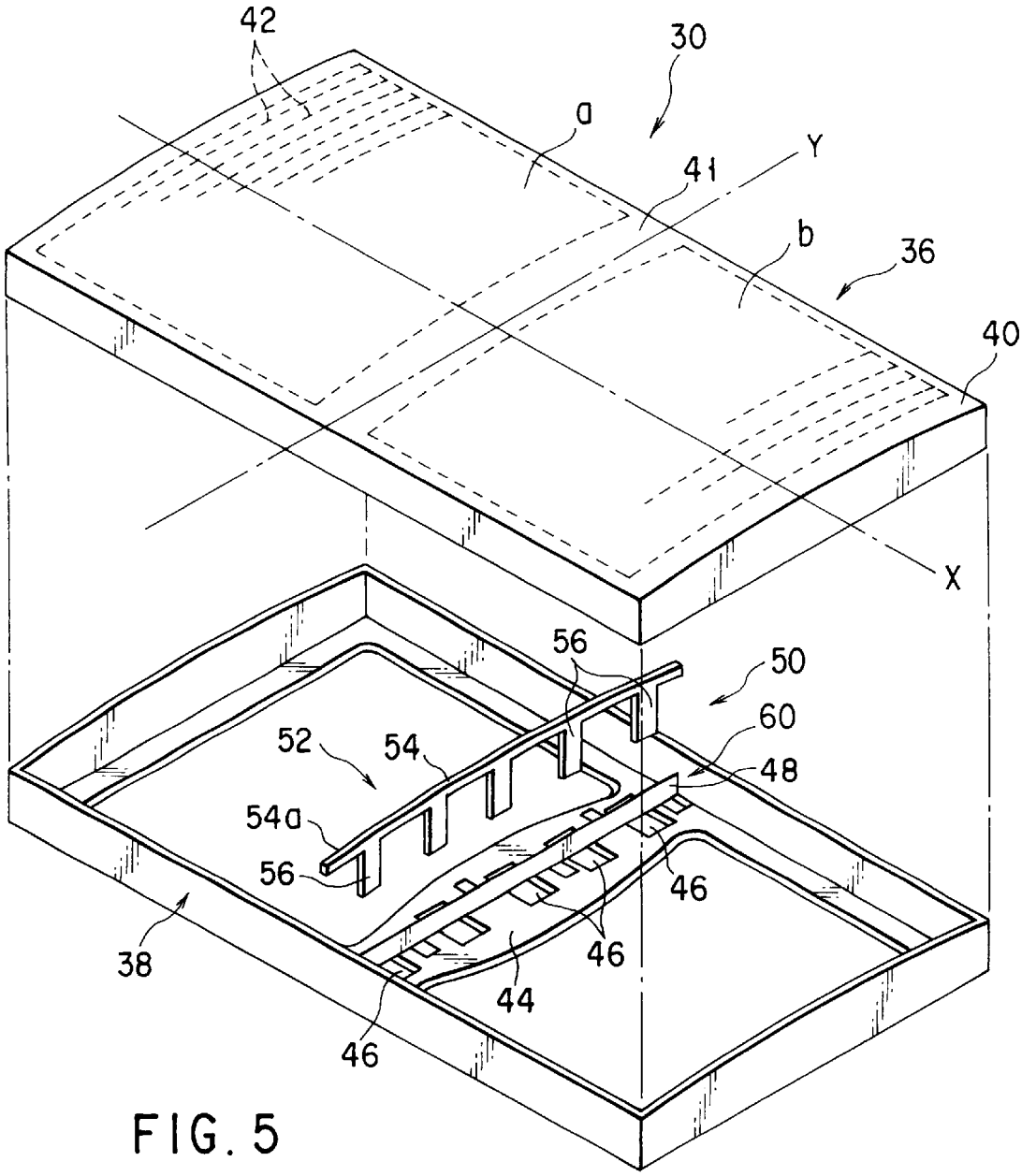

As shown in FIGS. 3 to 5, the coupling member 52 has an elongated coupler portion 54. The coupler portion 54 is welded to the inner surface of the boundary portion 41 of the mask body 36 and extends along the minor axis Y over the whole length of the boundary portion 41. The coupler portion 54 is opposed to the boundary C defined on the phosphor screen 15. A contact surface 54*a* of the coupler portion 54 that meets the mask body 36 is shaped substantially like an arc having the same curvature as a predetermined curvature of the mask body 36.

The coupling member 52 has a plurality of position adjustment tongues 56, for example, five position adjustment tongues 56 projecting from the coupler portion 54 in a direction parallel to the tube axis, that is, a direction permitting the position adjustment tongues 56 to recede from the mask body 36. The position adjustment tongues 56 are arranged along the minor axis Y with predetermined intervals.

The five position adjustment tongues 56 are passed through the five openings 46 bored in the middle frame 44 of the mask frame 38 with a clearance preserved in each opening. As described later, any of the position adjustment tongues 56 is picked and moved along the tube axis. Thus, the position of the portion of the mask body 36 adjacent to the picked position adjustment tongue can be adjusted along the tube axis. Consequently, the gap between the boundary portion 41 and the inner surface of the panel 12 (q value) can be adjusted at a plurality of points, that is, five points on the boundary portion 41 of the mask body 31. After the position of the mask body 36 is adjusted, the position adjustment tongues 56 are welded to the fixing portion 48 of the fixing member 60 fixed to the middle frame 44.

The color cathode-ray tube having the above-mentioned construction can be produced according to a manufacturing process described below. Upon forming a phosphor screen 15 on the inner surface of the face plate of the panel 12, the shadow mask 30 is attached to the panel 12 with the holder 32 engaged with the studs 34. The coupler portion 54 of the coupling member 52 is welded to the boundary portion 41 of the mask body 36 in advance. The position adjustment tongues 56 are passed through the openings 46 of the middle frame 44 but not fixed.

In this state, the panel 12 is mounted on an exposure unit that is not shown. Exposure light is emitted from a light source incorporated in the exposure unit to the inner surface of the panel via the shadow mask 30. The q value is measured at a plurality of points on the boundary portion 41. If the q value does not coincide with a predetermined value, the position adjustment tongues 56 are, as shown in FIG. 7A, used to adjust the q value.

Assume that, as shown in FIG. 7B, the q value coincides with the predetermined value. In this case, light A1 passed through an electron beam passage aperture a1, and light B1 passed through an electron beam passage aperture b1 fall on the boundary C defined on the inner surface of the face plate 18. The electron beam passage aperture a1 is located closest to the boundary portion 41 in the effective area a of the shadow mask 30, while the electron beam passage aperture b1 is located closest to the boundary portion 41 in the effective area b. In this case, position adjustment need not be carried out.

Assume that, as shown in FIG. 7C, the q value exceeds the predetermined value. In this case, the light A1 passed through the electron beam passage aperture a1 and the light B1 passed through the electron beam passage aperture b1 intersect before falling on the inner surface of the face plate 18. Consequently, light passed through the effective area a of the shadow mask 30 and light passed through the effective area b thereof overlap on the boundary C.

In this case, the position adjustment tongues 56 of the coupling member 52 are thrust towards the face plate 18 along the tube axis. The boundary portion 41 of the mask body 36 is thus displaced towards the face plate 18 together with the coupler portion 54. The q value coincides with the predetermined value in due course, that is, the light A1 and light B1 fall on the predetermined position on the boundary C on the inner surface of the face plate 18 in due course. At this time, the position adjustment tongues 56 are temporarily fixed to the fixing portion 48 of the fixing member 60 fixed to the middle frame 44 of the mask frame 38.

Assume that, as shown in FIG. 7D, the q value is smaller than the predetermined value. The light A1 passed through the electron beam passage aperture a1 and the light B1 passed through the electron beam passage aperture b1 does not intersect. Consequently, the light passed through the effective area a of the shadow mask 30 and the light passed through the effective area b thereof fall on the boundary C while having a gap, that is, a break between them.

In this case, the position adjustment tongues 56 of the coupling member 52 are pulled along the tube axis in a direction permitting the position adjustment tongues to recede from the face plate 18. The boundary portion 41 of the mask body 36 is thus displaced together with the coupler portion 54 in a direction permitting the boundary portion to recede from the face panel 18. The q value coincides with the predetermined value in due course, that is, the light A1 and light B1 intersect on the boundary C defined on the inner surface of the face plate 12 in due course. At this time, the position adjustment tongues 56 are fixed temporarily to the fixing portion 48 fixed to the middle frame 44 of the mask frame 38.

The foregoing adjustment of the q value is carried out at all the positions of the five position adjustment tongues 56. When the adjustment has been completed at all the positions, the position adjustment tongues are welded to the fixing portion 48. The boundary portion 41 of the mask body 36 is fixed to the mask frame 38 with the coupling member 52 and fixing member 60 between them. The aforesaid adjustment of the q value is carried out in units of several hundred pm to several $\mu$m. The range from several hundred $\mu$m to several $\mu$m is largely different from an adjustment range from several hundred $\mu$m to several thousand $\mu$m in units of which adjustment is performed on a typical color cathode-ray tube.

Thereafter, the shadow mask 30 is detached temporarily from the panel 12, and a phosphor material is applied to the inner surface of the face plate 18. The shadow mask 30 is then attached to the panel 12 again. The panel 12 is mounted on the exposure unit, and the phosphor layer is exposed to light via the shadow mask 30. Thereafter, the phosphor layer is etched in order to remove unnecessary parts. The foregoing steps are repeated relative to each of phosphor materials of red, blue, and green. Thereafter, a black stripe substance is attached to the phosphor layer in order to form black stripes. The phosphor screen 15 thus ensues.

In the course of forming the phosphor screen, the q value is adjusted high precisely at a plurality of points on the boundary portion 41 of the mask body 36 and thus coincided with the predetermined value in advance. The phosphor layer of the phosphor screen 15 is formed with phosphor dots arranged continuously at intervals of a predetermined pitch, so that neither an overlap nor break will be created over the whole boundary C between the scanning regions A and B.

Thereafter, the rear housing 14 is coupled to the skirt portion 20 of the panel 12 having the phosphor screen 15 formed thereon. The electron guns 24 are locked in the necks 22, and the deflection units 28 are mounted on the external surfaces of the funnels 16. The color cathode-ray tube is thus completed.

In the color cathode-ray tube having the foregoing components, the shadow mask 30 has the position adjustment mechanism 50 used to adjust the q value. At a step preceding the step of assembling the components of the vacuum envelope 10, the q value can be adjusted accurately at a plurality of points on the boundary portion 41 of the mask body 36. With the q value adjusted highly precisely, the phosphor screen 15 can be formed on the inner surface of the panel 12. The incidence position of an electron beam can be determined highly precisely over the whole boundary C between the scanning regions A and B of the phosphor screen. Consequently, the continuity among the phosphor dots to be arranged at intervals of a predetermined pitch can be maintained without creation of an overlap or break on the boundary C.

Moreover, after the q value is adjusted using the position adjustment mechanism 50, the coupling member 52 is fixed to the middle frame 44 of the mask frame 38 with the fixing portion 48 between them. The boundary portion 41 of the mask body 36 can therefore be held at the predetermined position relative to the boundary C defined on the phosphor screen 15, or in particular, held with the predetermined q value maintained relative to the boundary C. In other words, the coupling member 52 fixed to the mask body 36 and mask frame 38 restrains the shadow mask 36 from thermally expanding or moving along the tube axis due to doming. Moreover, the coupling member 52 restrains the shadow mask from moving along the tube axis due to extraneous vibrations.

When the phosphor screen 15 is scanned via the shadow mask 30 using electron beams, sub-images rendered in the scanning regions A and B will be joined without an overlap or break created on the boundary C. One continuous image can be produced, and image definition can be improved.

In the color cathode-ray tube having the aforesaid components, the mask frame 38 has the middle frame 44. The mask frame 38 therefore exhibits improved rigidity. The mask frame can bore the mask body 36 more reliably. Due to the improved rigidity, the thickness of the mask frame can be reduced. This leads to a lightweight shadow mask.

The middle frame 44 is formed as an integral part of the mask frame 38. The shadow mask 30 is attached to the panel 12 with the holder 32 engaged with the studs 34 in the same manner as it is conventionally. The shadow mask 30 can be readily attached or detached to or from the panel 12. The color cathode-ray tube can be produced without the necessity of largely modifying the manufacturing process for producing a typical color cathode-ray tube. Moreover, the middle frame 44 can be produced during press working performed on the mask frame 38. The inclusion of the middle frame will hardly increase the cost of the mask frame. Consequently, an increase in the cost required to produce the color cathode-ray tube can be suppressed.

Furthermore, the middle frame 44 is shaped like a longitudinal section of a barrel and has the ability to block unnecessary electrons of electron beams emitted from the electron guns 24 which are likely to invade into the adjoining scanning regions. Moreover, the inclusion of the middle frame 44 in the mask frame 38 makes a geomagnetic effect, which affects the electron beams passing through the effective areas a and b of the shadow mask 30, symmetrical to the mask body. Consequently, a magnetic effect affecting the electron beams can be minimized.

According to the color cathode-ray tube, the fixing member 60 having the fixing portion 48 is fixed to the middle frame 44 and extended over the whole length of the middle frame. The fixing member 60 works to reinforce the structure of the middle frame, whereby the stability of the mask frame 38 is expected to improve. The fixing portion 48 of the fixing member 60 extends along the tube axis. This exerts the same effect as when the middle frame is made thicker. Consequently, the rigidity of the middle frame 44 has improved and a warp thereof can be suppressed.

The mask frame 38 is the firmest and most stable member among the internal structures of the color cathode-ray tube. Nevertheless, the middle frame 44 is included in the mask frame and the coupling member 52 is fixed to the middle frame. Therefore, the shadow mask in which the distance between the mask body 36 and mask frame 38 has been adjusted highly precisely can be held intact firmly on a stable basis.

The present invention is not limited to the aforesaid embodiment, but various variants can be formed within the scope of the present invention. For example, the fixing portion of the mask frame employed in the aforesaid embodiment is realized with a separate fixing member. Alternatively, the fixing portion may be unified with the middle frame of the mask frame.

Figure 8:
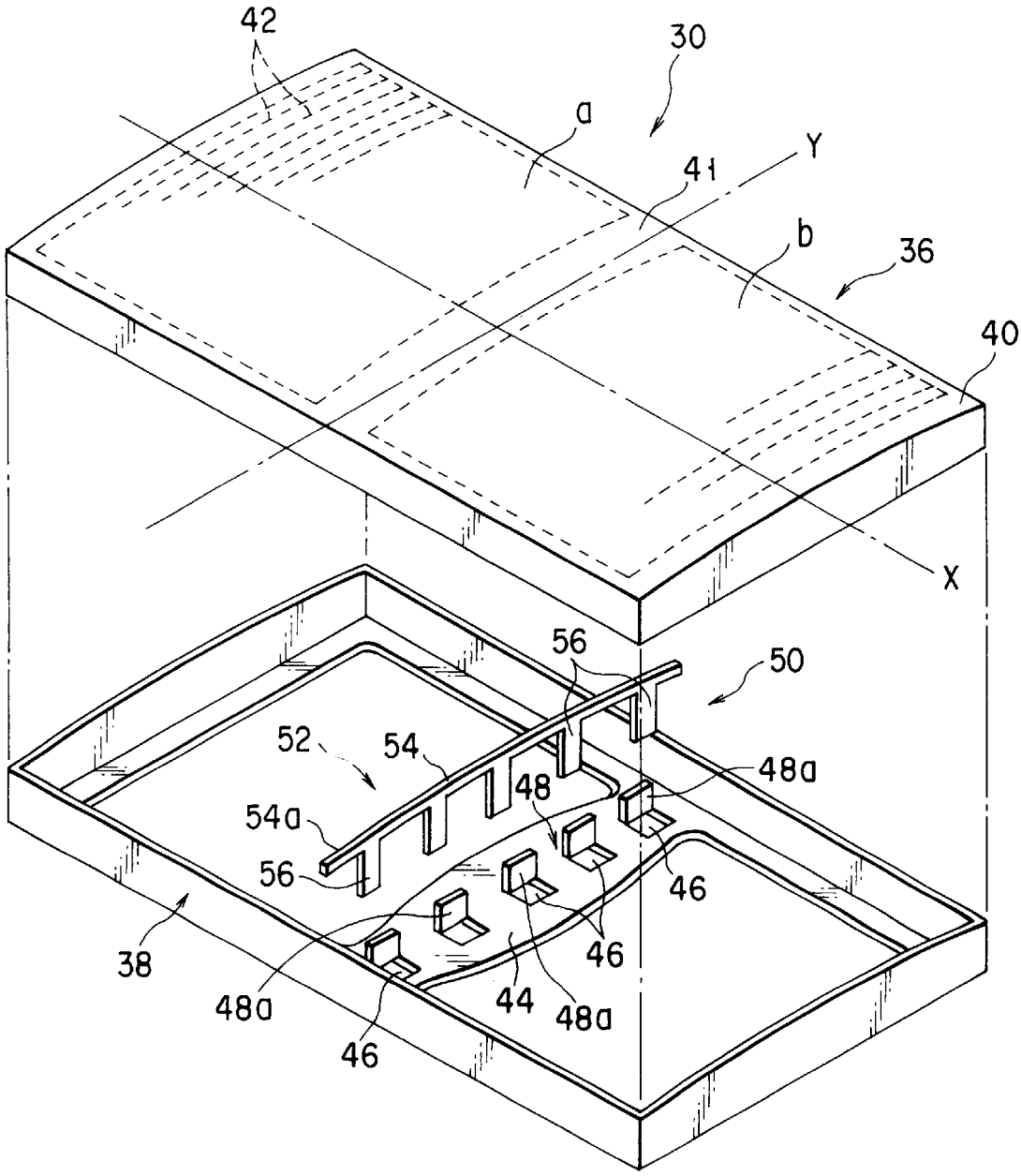
FIG. 8 is an exploded perspective view showing a shadow mask included in a color cathode-ray tube according to another embodiment of the present invention.

As shown in FIG. 8, according to another embodiment of the present invention, similarly to the aforesaid embodiment, the mask frame 38 of the shadow mask 30 has the middle frame 44 as an integral part thereof. The middle frame 44 extends from the center of one long-side wall to the center of the other long-side wall. The middle frame 44 has a plurality of openings 46 arranged in the longitudinal direction with a predetermined intervals.

According to this embodiment, the fixing portion 48 to which the coupling member 52 of the position adjustment mechanism 50 is welded is formed as an integral part of the middle frame 44. The fixing portion 48 consists of a plurality of bent strips 48*a* that are formed by erecting the portions of the middle frame 44 corresponding to the openings 46 and bending them nearly vertically. After the position of the mask body 36 is adjusted, the coupling member 52 is welded to the plurality of bent strips 48*a*.

The other components are identical to those of the aforesaid embodiment. The same reference numerals will be assigned to the identical components. The description of the components will be omitted.

According to this embodiment, the independent fixing member can be excluded, and the step of welding the fixing member to the mask frame can be omitted. The cost required to produce the mask frame can be further lowered. In the case of the mask frame having the foregoing structure, a reinforcement member may be attached to the middle frame if necessary. This frame structure makes it possible to hold the shadow mask intact on a sufficiently stable basis.

Figure 9A:
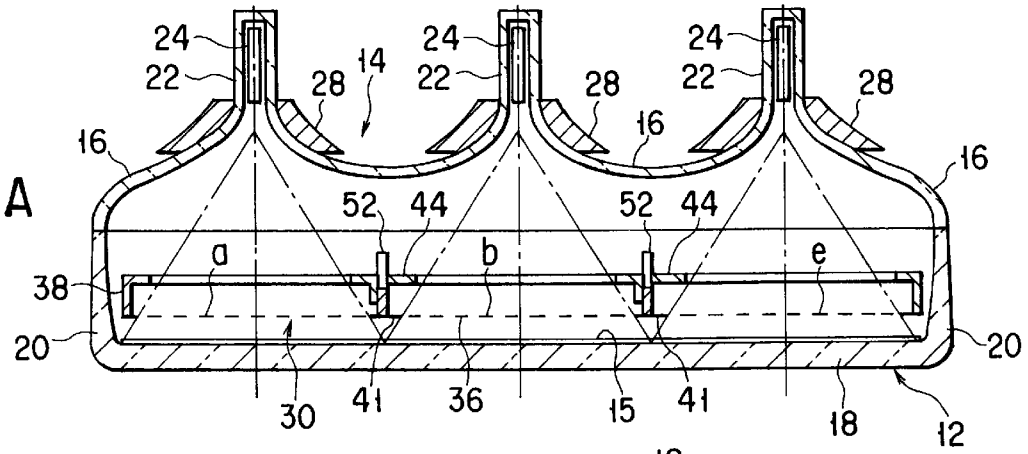
FIGS. 9A to 9C are a sectional view, a front view, and a sectional view respectively showing a color cathode-ray tube according to still another embodiment of the present invention.
Figure 9B:
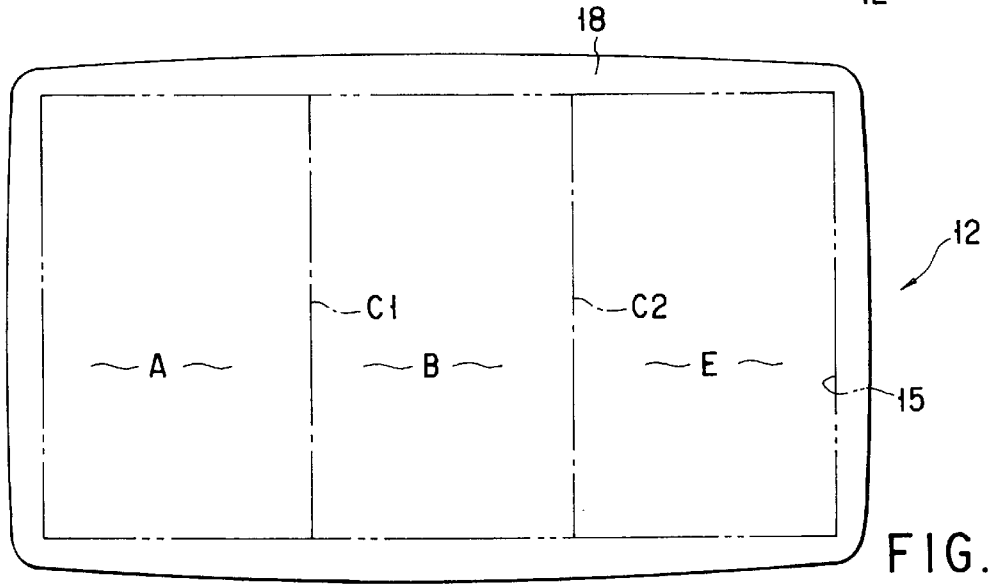
Figure 9C:
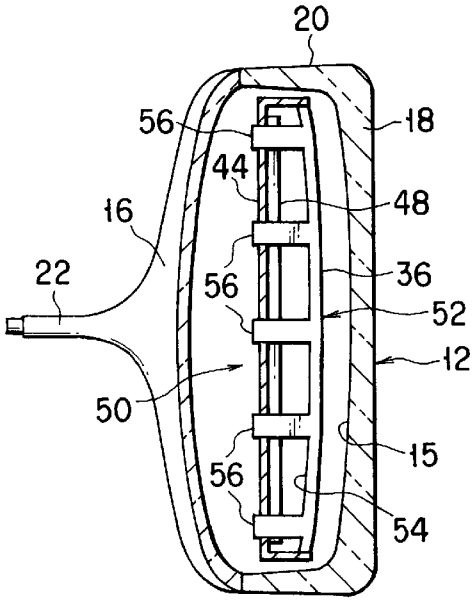

In the color cathode-ray tube of this embodiment, the number of scanning regions of the phosphor screen is not limited to two but may be increased if necessary. According to another embodiment shown in FIGS. 9A to 9C, the phosphor screen 15 has three rectangular scanning regions A, B, and E defined side by side along the major axis X. The scanning regions A, B, and E are mutually adjacent with boundaries C1 and C2 among them. Accordingly, the rear housing 14 has three funnels 16 and three necks 22. The electron gun 24 is disposed in each neck. Moreover, the deflection unit 28 is mounted on the external surface of each funnel 16.

The mask body 36 of the shadow mask 30 has three effective areas a, b, and e corresponding to the three scanning regions A, B, and E, respectively. Two boundary portions 41 are defined among the effective areas a, b, and e and opposed to the boundaries C1 and C2 among the scanning regions of the phosphor screen 15. The coupling members 52 of the position adjustment mechanism 50 having the same structure as that employed in the aforesaid embodiment are fixed to the respective boundary portions 41 of the mask body 36.

The mask frame 38 has a pair of middle frames 44, which extend between a pair of long-side walls, as integral parts thereof. The middle frames 44 are opposed to the respective boundary portions 41 of the mask body 36. The middle frames 44 have the same structure as that employed in the aforesaid embodiment. After the position of the mask body 36 is adjusted, the coupling members 52 are fixed to the middle frames 44 with the fixing portions 48 between them.

The other components are identical to those of the aforesaid embodiment. The same reference numerals will be assigned to the identical components. The description of the components will be omitted.

Even in the color cathode-ray tube having the foregoing components, the q value can be adjusted at a plurality of points on each of the boundary portions 41 of the mask body 36. After the adjustment is completed, the shadow mask is restrained from moving along the tube axis, and the boundaries and areas defined in the shadow mask can be held at the predetermined positions. Moreover, the inclusion of the middle frames 44 in the mask frame 38 increases the rigidity of the mask frame. Moreover, the mask body 38 can be reliably held at its adjusted position on a stable basis. This embodiment exerts the same operations and advantages as the aforesaid embodiment.

According to the aforesaid embodiments, the phosphor screen has a plurality of regions thereof, which is defined side by side along the major axis of the panel, scanned mutually independently. Alternatively, the scanning regions may be defined side by side along the minor axis of the panel. In this case, a boundary between the scanning regions extends along the major axis, and the middle frame and adjustment member are arranged along the boundary.

According to the present invention, the shadow mask is not limited to the combination of the mask body having the electron beam passage apertures bored therein and the mask frame. Alternatively, a color identification electrode to be employed according to the aperture grille method will do. When this kind of color identification electrode is employed, the same operations and advantages as those of the aforesaid embodiments can be exerted.

Moreover, the number of position adjustment tongues included in the adjustment member may be increased or decreased if necessary. The shape of the adjustment member is not limited to the comb-like shape. As long as the position of the mask body can be adjusted along the tube axis, the adjustment member may have any shape. Likewise, the shape of the middle frame and the number of openings can be determined arbitrarily.

Furthermore, the present invention may be adapted to a split scanning color cathode-ray tube in which a coupling member need not be fixed. Moreover, if necessary, the middle frame and fixing member may have a reinforcing portion, and may have the structures thereof reinforced. The mask body is not limited to the structure having a plurality of effective areas defined thereon but may have a structure having only one effective area.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cathode-ray tube comprising:

a vacuum envelope including a panel that has a phosphor screen formed on an inner surface thereof;

a plurality of electron guns disposed in the vacuum envelope, for emitting electron beams to the phosphor screen and dividedly scanning a plurality of scanning regions on the phosphor screen;

a shadow mask arranged between the phosphor screen and the electron guns and including a substantially rectangular mask body and a substantially rectangular mask frame attached to the periphery of the mask body, the mask body having a plurality of effective areas which include numerous electron beam passage apertures and are defined in association with the scanning regions, and a boundary portion defined between the effective areas and opposing to the boundary between the scanning regions of the phosphor screen; and a coupling member coupled to the boundary portion of the mask body and the mask frame in order to hold the boundary portion of the mask body at a predetermined position.

2. A cathode-ray tube according to claim 1, wherein the coupling member is fixed to the inner surface of the mask body, extends over substantially the whole length of the boundary portion of the mask body and is coupled to the mask frame.

3. A cathode-ray tube comprising a vacuum envelope including a panel that has a phosphor screen formed on an inner surface thereof;

a plurality of electron guns disposed in the vacuum envelope, for emitting electron beams to the phosphor screen and dividedly scanning a plurality of scanning regions on the phosphor screen;

a shadow mask arranged between the phosphor screen and the electron guns and including a substantially rectangular mask body and a substantially rectangular mask frame attached to the periphery of the mask body, the mask body having a plurality of effective areas which include numerous electron beam passage apertures and are defined in association with the scanning regions, and a boundary portion defined between the effective areas and opposing to the boundary between the scanning regions of the phosphor screen; and a position adjustment mechanism having an adjustment member coupled to the boundary portion of the mask body and the mask frame and configured to adjust the gap between the inner surface and the panel and the mask body at a plurality of positions on the boundary portion of the mask body.

4. A cathode-ray tube according to claim 3, wherein the adjustment member includes a coupler portion extending along the boundary portion of the mask body, and a plurality of position adjustment tongues projecting from a plurality of positions on the coupler portion in a direction opposite to the phosphor screen and used to adjust the position of the mask body along a tube axis via the coupler portion.

5. A cathode-ray tube according to claim 4, wherein the coupler portion of the adjustment member is fixed to the inner surface of the boundary portion of the mask body; and the position adjustment tongues are coupled to the mask frame after used to adjust the gap between the shadow mask and the inner surface of the panel.

6. A cathode-ray tube according to claim 5, wherein the mask frame includes a middle frame opposed to the boundary portion of the mask body, and a plurality of openings which are bored in the middle frame and through which the position adjustment tongues are passed; and the position adjustment tongues are coupled to the middle frame.

7. A cathode-ray tube according to claim 4, wherein the panel and the shadow mask are shaped substantially in a rectangle, and have a major axis and a minor axis that are perpendicularly passing through a tube axis; the boundary between the scanning regions extents substantially in parallel with the minor axis; the coupler portion of the adjustment member extends along the minor axis; and the plurality of position adjustment tongues are arranged along the minor axis with predetermined intervals.

8. A cathode-ray tube according to claim 3, wherein the phosphor screen has two scanning regions defined thereon, the mask body has two effective areas corresponding to the respective scanning regions and has a boundary portion defined between the effective areas.

9. A cathode-ray tube according to claim 3, wherein the phosphor screen has three scanning regions defined side by side; and the mask body has three effective areas corresponding to the respective scanning regions, and has two boundary portions each defined between two adjacent effective areas.

10. A cathode-ray tube comprising:

a vacuum envelope including a panel that has a phosphor screen formed on an inner surface thereof, a shadow mask arranged in the vacuum envelope and opposing the phosphor screen; and a plurality of electron guns incorporated in the vacuum envelope, for omitting electron beams to the phosphor screen via the shadow mask, and dividedly scanning a plurality of scanning regions on the phosphor screen, wherein the shadow mask includes a mask body having a plurality of effective areas in which numerous electron beam passages apertures are bored and a boundary portion defined between the effective areas and opposed to the boundary between the scanning regions of the phosphor screen, and a substantially rectangular mask frame holding the periphery of the mask body, the mask frame includes a pair of long-side walls and a middle frame extending from one of the long-side walls to the other of the long side walls and opposing the boundary portion of the mask body; and the shadow mask includes a coupling member coupled to the boundary portion of the mask body and the middle frame of the mask frame.

11. A cathode-ray tube according to claim 10, wherein the shadow mask includes a coupling member coupled to the boundary portion of the mask body and the coupling member is fixed to the middle frame of the mask frame.

12. A cathode-ray tube according to claim 10, wherein the mask frame includes a fixing member fixed to the middle frame; and the fixing member includes a fixing portion extending from the middle frame along the tube axis and the coupling member is fixed to the fixing portion.

13. A cathode-ray tube according to claim 10, wherein the mask frame includes a fixing portion formed by cutting and erecting part of the middle frame; and the coupling member is fixed to the fixing portion.

14. A cathode-ray tube according to claim 10, wherein the coupling member includes a coupler portion fixed to the boundary portion of the mask body and extending over substantially the whole length of the boundary portion, and a plurality of position adjustment tongues extending from a plurality of positions on the coupler portion in a direction opposite of the phosphor screen and used to adjust the position of the mask body along the tube axis via the coupler portion.

15. A cathode-ray tube according to claim 14, wherein the position adjustment tongues are fixed to the middle frame of the mask frame after used to adjust the gap between the mask body and the inner surface of the panel.

16. A cathode-ray tube according to claim 14, wherein the panel and the shadow mask are shaped in a substantially rectangle and have a major axis and a minor axis that are perpendicularly passing through a tube axis;

the boundary between the scanning regions extends substantially in parallel with the minor axis;

the coupler portion of the coupling member extends along the minor axis; and the plurality of position adjustment tongues is arranged along the minor axis with predetermined intervals.

17. A cathode-ray tube according to claim 14, wherein the middle frame has a plurality of openings, through which the position adjustment tongues are passed.

18. A cathode-ray tube according to claim 10, wherein the phosphor screen has two scanning regions defined therein, and the mask body has two effective areas corresponding to the respective scanning regions and has a boundary portion defined between the effective areas.

19. A cathode-ray tube according to claim 10, wherein the phosphor screen has three scanning regions defined side by side; the mask body has three effective areas corresponding to the respective scanning regions and has two boundary portions defined among the adjoining effective areas; and the mask frame includes two middle frames opposed to the boundary portions.

20. A cathode-ray tube according to claim 10, wherein the middle frame is shaped substantially like a longitudinal section of a barrel, and has the width thereof increased from both ends thereof to the center thereof.

* * * * *